US009192853B2

(12) United States Patent
Riggles

(10) Patent No.: US 9,192,853 B2
(45) **Date of Patent: *Nov. 24, 2015**

(54) AMUSEMENT MACHINE INCLUDING A CRANE GAME IN COMBINATION WITH A THERMAL PRINTER

(75) Inventor: Brian Keith Riggles, St. Louis, MO (US)

(73) Assignee: S&B Entertainment Inc., St. Louis, MO (US)

( * ) Notice: Subject to any disclaimer, the term of this patent is extended or adjusted under 35 U.S.C. 154(b) by 448 days.

This patent is subject to a terminal disclaimer.

(21) Appl. No.: 13/606,639

(22) Filed: Sep. 7, 2012

(65) Prior Publication Data

US 2013/0231166 A1 Sep. 5, 2013

Related U.S. Application Data

(63) Continuation-in-part of application No. 13/411,525, filed on Mar. 3, 2012.

(51) Int. Cl.

| | |
|---|---|
| ***A63F 9/24*** | (2006.01) |
| ***A63F 9/30*** | (2006.01) |
| ***G07F 17/32*** | (2006.01) |
| ***G07F 17/34*** | (2006.01) |

(52) U.S. Cl.

CPC ..... *A63F 9/30* (2013.01); *G07F 17/3297* (2013.01); *G07F 17/34* (2013.01); *A63F 2009/2455* (2013.01); *A63F 2250/146* (2013.01)

(58) Field of Classification Search

USPC ..... 273/138.1, 142 R, 142 H, 440, 447, 448, 273/454, 459, 460

See application file for complete search history.

(56) References Cited

U.S. PATENT DOCUMENTS

| | | | | |
|---|---|---|---|---|
| 5,711,530 | A * | 1/1998 | Lewis | 273/448 |
| 6,050,895 | A * | 4/2000 | Luciano et al. | 463/7 |
| 6,152,447 | A * | 11/2000 | Stanley | 273/138.1 |
| 6,267,669 | B1 * | 7/2001 | Luciano et al. | 463/7 |
| 6,939,229 | B2 * | 9/2005 | McClintic | 463/25 |
| 7,614,951 | B2 * | 11/2009 | Flemming et al. | 463/20 |
| 7,857,318 | B1 * | 12/2010 | Shoemaker et al. | 273/448 |
| 2006/0016883 | A1 * | 1/2006 | Silva et al. | 235/381 |
| 2006/0255544 | A1 * | 11/2006 | Halliburton | 273/447 |
| 2007/0114725 | A1 * | 5/2007 | Peck et al. | 273/447 |
| 2008/0009331 | A1 * | 1/2008 | Moffett et al. | 463/3 |
| 2009/0191931 | A1 * | 7/2009 | Peck | 463/7 |

* cited by examiner

*Primary Examiner* — Nini Legesse
(74) *Attorney, Agent, or Firm* — White Welker & Welker, LLC; Matthew T. Welker, Esq.

(57) ABSTRACT

Coin operated amusement device including a crane game, a game of chance, and a simulated slot machine in combination. The Amusement device also includes a credit card swipe component for accepting payment. The credit card swipe component can also accept and player cards commonly issued by casinos and other merchants for playing machines in their locations for payment and storing or crediting winnings. The amusement device also includes a thermal printer for generating and printing tickets for location/retailer specific coupons or other awards that can be used at the location, online, or with other merchants in a specific area.

19 Claims, 11 Drawing Sheets

AMUSEMENT MACHINE INCLUDING A CRANE GAME IN COMBINATION WITH A THERMAL PRINTER

CROSS REFERENCE TO RELATED APPLICATIONS

This application is a continuation in part of U.S. patent application Ser. No. 13/411,525, entitled "AMUSEMENT MACHINE INCLUDING A CRANE GAME IN COMBINATION WITH A WIN EVERY TIME GAME AND A GAME OF CHANCE", filed on 3 Mar. 2012. The aforementioned application is hereby incorporated herein by reference.

This application is related to U.S. Provisional Patent Application Ser. No. 61/502,190, entitled "AMUSEMENT MACHINE INCLUDING A CRANE GAME IN COMBINATION WITH A WIN EVERY TIME GAME AND A GAME OF CHANCE", filed on 28 Jun. 2011. The aforementioned application is hereby incorporated herein by reference.

This application is related to U.S. Provisional Patent Application Ser. No. 61/502,190, entitled "AMUSEMENT MACHINE INCLUDING A CRANE GAME IN COMBINATION WITH A WIN EVERY TIME GAME AND A GAME OF CHANCE", filed on 28 Jun. 2011. The aforementioned application is hereby incorporated herein by reference.

This application is related to U.S. Provisional Patent Application Ser. No. 61/474,347, entitled "AMUSEMENT MACHINE INCLUDING A CRANE GAME IN COMBINATION WITH A WIN EVERY TIME GAME AND A GAME OF CHANCE", filed on 12 Apr. 2011. The aforementioned application is hereby incorporated herein by reference.

This application is related to U.S. Provisional Patent Application Ser. No. 61/449,030, entitled "AMUSEMENT MACHINE INCLUDING A CRANE GAME IN COMBINATION WITH A WIN EVERY TIME GAME AND A GAME OF CHANCE", filed on 3 Mar. 2011. The aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates generally to an amusement machine. More specifically, the present invention relates to an amusement machine in which a player activates a crane in a housing or cabinet in an attempt to pick up a prize from a selection of prizes and carry it to an outlet and also issues tickets and coupons from a thermal printer.

BACKGROUND OF THE INVENTION

A claw crane (also called a variety of other names) is a type of arcade game known as a merchandiser, commonly found in video arcades, supermarkets, restaurants, movie theaters, and bowling alleys. A claw crane may also be referred to as a teddy picker, candy crane, claw machine, crane vending machine, arcade claw, grab machine, crane game or simply the claw.

A claw crane consists of many parts, but the basic components are a PCB, power supply, currency detector, credit/timer display, joystick, wiring harness, bridge assembly, and claw. The claw will have two or more prongs or arms, although most claws will usually have three.

The cabinet is usually constructed of medium-density fiberboard (MDF), plywood or other wood or plastic materials. Some cabinets are made of aluminum alloy or other metals such as 18 gauge steel, which makes it easier to relocate as well as cheaper to produce. The window at the front of the machine is normally made of glass or a cheaper-to-manufacture substitute, such as acrylic. The marquee is a branded graphic sometimes created specifically for restaurants or an operator's business name behind the front.

A claw vending machine consists of prizes, usually plush toys or alternatives such as jewelry, capsulated toys, hats, balls, dolls, shirts, candy and electronics. Higher end and more expensive prizes are sometimes placed in a plastic bag so the toy is harder to pick up. The player places coins into the machine, which then allows the player to manipulate a joystick that controls the claw for a variable time (controlled by the operator) usually 15 to 30 seconds (in some cases, a claw vending machine might offer a minute of time). The player is able to move the claw back, forth and sideways, although some machines allow the player to move the claw after it has partially descended.

At the end of the play time (or earlier if the player presses a trigger button on the joystick), the claw descends down and makes an attempt to grip. After making the gripping attempt, the claw then moves over an opening in the corner of the case and releases its contents. If the player is successful, then the prize the claw is holding is dropped into the opening and dispensed through a chute into a hatch for collection.

An alternative version of the machine, popular in arcades, is the two-button version: one marked with a forward arrow, one with a right arrow. The crane starts near the front, left side of the machine and the player presses first the forward button to move the crane towards the back of the cabinet. Once the button is released the crane stops moving and the button cannot be used again, thus requiring the player to judge depth accurately in one attempt. After this, the right button becomes active in a similar way and as soon as it is released, the crane drops to a certain depth and then raises, closing its claw on the way and returning to the drop hatch in the front left corner. These versions are generally considered to be more difficult. However, the button type machines typically do not feature the timers, which are commonly found on joystick type machines.

The success rate winning a prize is dependent on several factors, including operator settings, player skill, depth perception, type of machine, and prizes available (size, density, and distribution). A prize may be lost due to player inexperience, player error in manipulating the claw, or the specific crane configuration.

Many modern cranes use a computer to determine a payout percentage based on the operators settings, in the manner that the claw would have a strong grasp on objects only on a certain percentage of attempts. All modern claw machines incorporate some means for the owner to adjust at least the strength of the claw's grip and how closely the claw's fingers pull together, usually with screws on the mechanism or potentiometers on the PCB. Even on older machines, the grip strength can be adjusted by adding circuit components or additional hardware. Some machines incorporate a feature called two-level claw power, which, when enabled, causes the claw to at first grip at full strength, but then weaken its grip to the normal level after a brief delay. This can cause the crane to initially pick up the prize, but then drop it. Modern, higher-end claw machines are fully computerized and are remotely programmable by the owner (via a hand-held device).

SUMMARY OF THE INVENTION

The present invention is a coin operated amusement device that is comprised of a crane game and a thermal printer for dispensing tickets or coupons. The crane machine game and thermal printer can also be used in combination with a win every time game and/or a simulated slot machine. When a player deposits their coins, they are able to play one or more of the games depending on the embodiment of the invention. One game is a traditional crane game. A second game requires a player to press a button to stop moving, flashing lights on an area to win a prize. The second game is located on the corners of the cabinet and above the marquee on the top of the crane game machine cabinet. Finally, in a third game, the player plays a slot machine game located on the marquee of the crane machine component of the device. If the player wins the slot machine game, the prize is tickets that can be redeemed via an online website/store.

The games may be played in any order or combination, the prizes may be adjust as desired by the operator. The game play of each game may also be adjusted by the operator to control winning percentages and payouts.

Additionally, the amusement device of the present invention is used in combination with a thermal printer for printing tickets and coupons. This provides multiple benefits. The first is that operators have reduce service time as the thermal printer can print many more tickets and a larger variety of tickets or coupons compared to the standard ticket dispensing machines. Additionally, machines can be programmed to print coupons targeted to the local area of the machine, rather than being loaded with generic or pre-selected coupons that may have less relevancy to a winner. Waste is also reduced as the printer can be programmed to print different tickets or coupons rather than rolls of tickets or coupons being wasted or thrown away that were not dispensed. The thermal printer may dispense tickets or coupons for the game or games played and in any order or combination thereof.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figures, it is possible to see the various major elements constituting the apparatus of the present invention.

Figure 1:
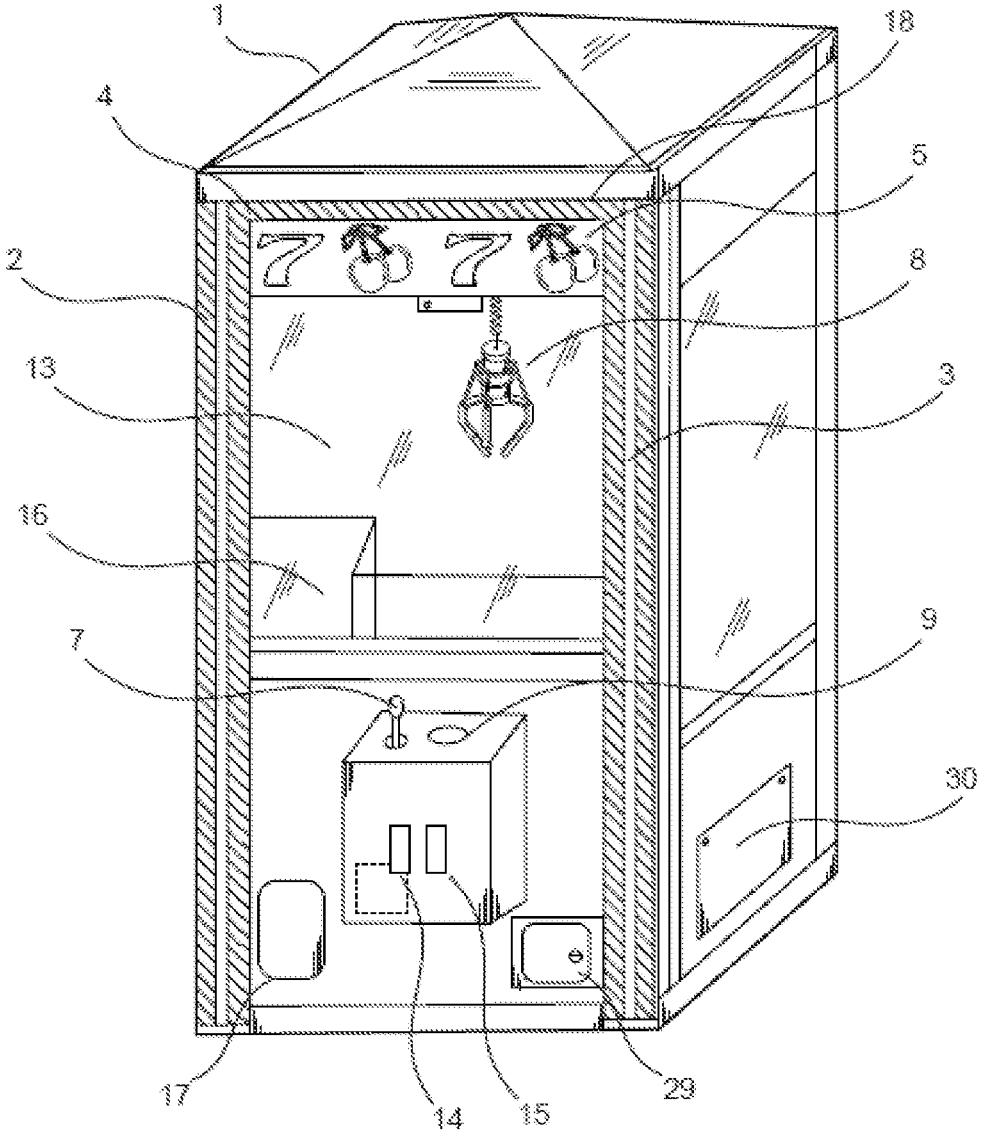
FIG. 1 is a perspective view of an amusement machine illustrating the crane machine and the marquee of the crane machine cabinet containing the games of chance and win every time games according to the present invention.

Now referring to the Figures, the present invention is a coin operated amusement device that is comprised of a crane game, a game of chance, and a simulated slot machine in combination as shown in FIG. 1. When a player deposits their coins, they are able to play three games. One game is a traditional crane game. A second game requires a player to press a button to stop moving, flashing lights on an area to win a prize. The second game is located on the corners 2 and 3 of the cabinet 1 and above the marquee 5 on the top 4 of the crane game machine cabinet 1 as shown in FIG. 1. In the second game, the player may or may not be guaranteed to win a prize and the prizes may be products, tickets, award a price, additional crane free plays, or moving on to or access the third game for playing.

Finally, in a third game, the player plays a slot machine game located on the marquee 5 of the crane machine cabinet 1 of the device as shown in FIG. 1. If the player wins the slot machine game, the prize may be products or tickets that can be redeemed via an online website/store or even additional crane free plays.

Figure 2:
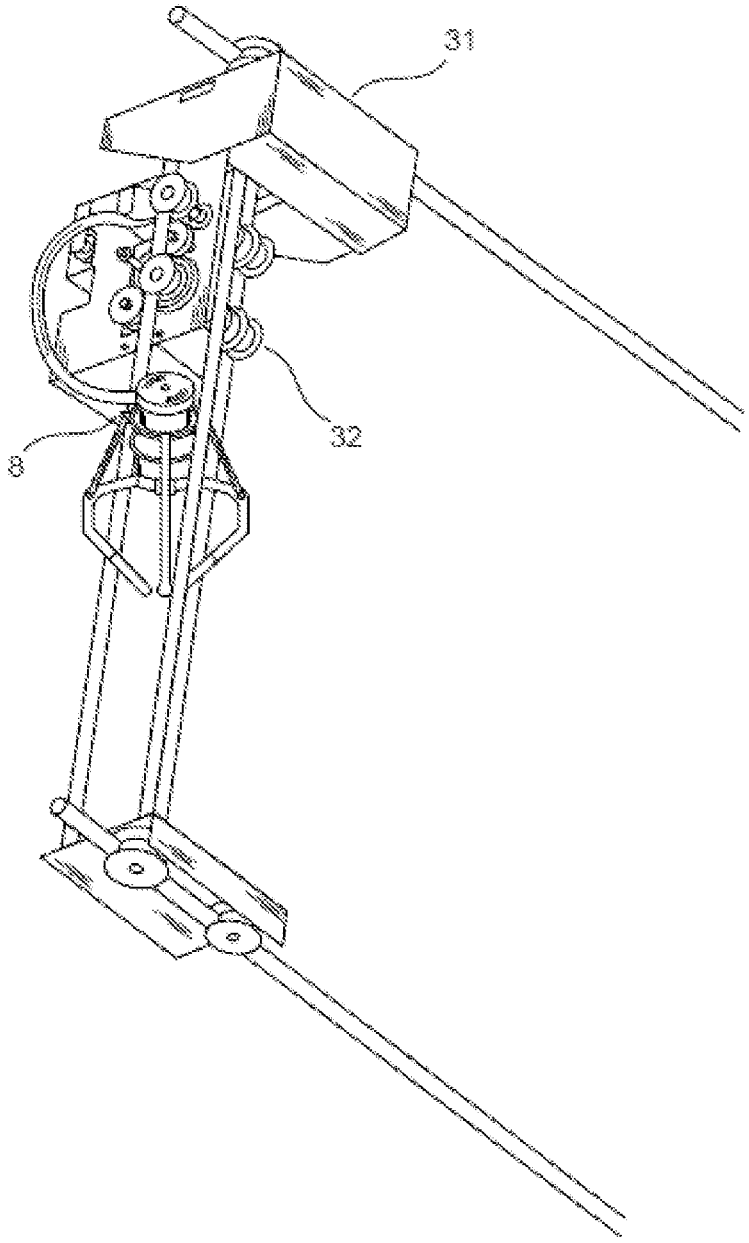
FIG. 2 is a perspective view of the crane apparatus according to the present invention.
Figure 3:
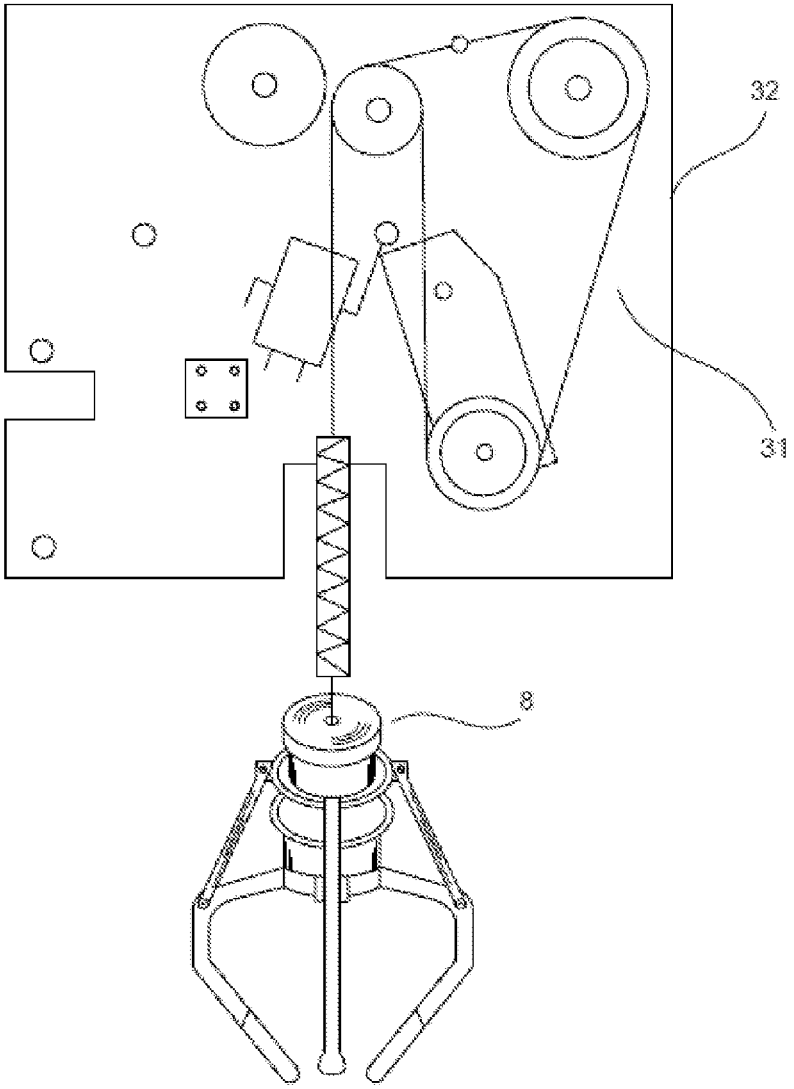
FIG. 3 is a perspective view of the crane apparatus according to the present invention.
Figure 4:
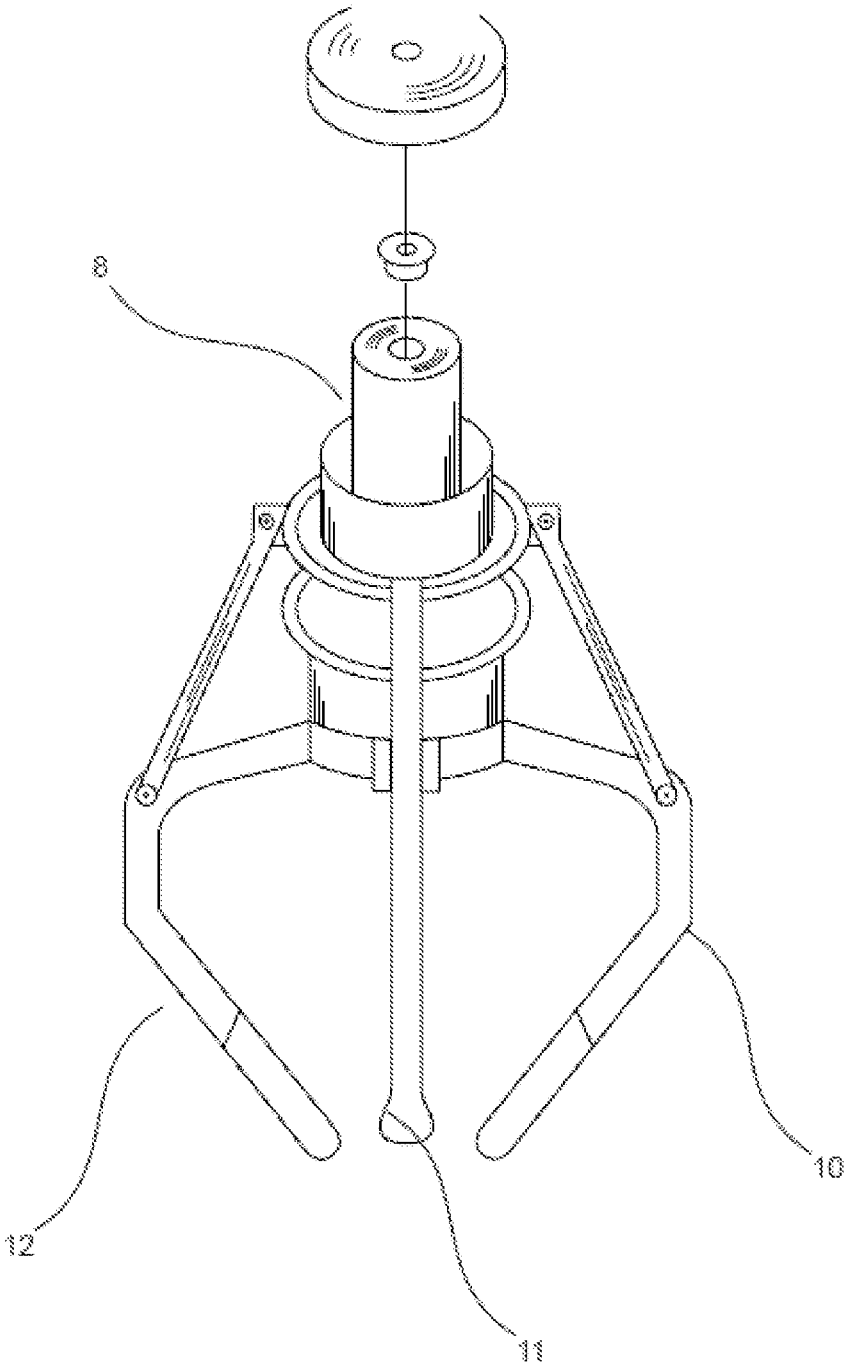
FIG. 4 is a perspective view of the crane claw apparatus according to the present invention.
Figure 5:
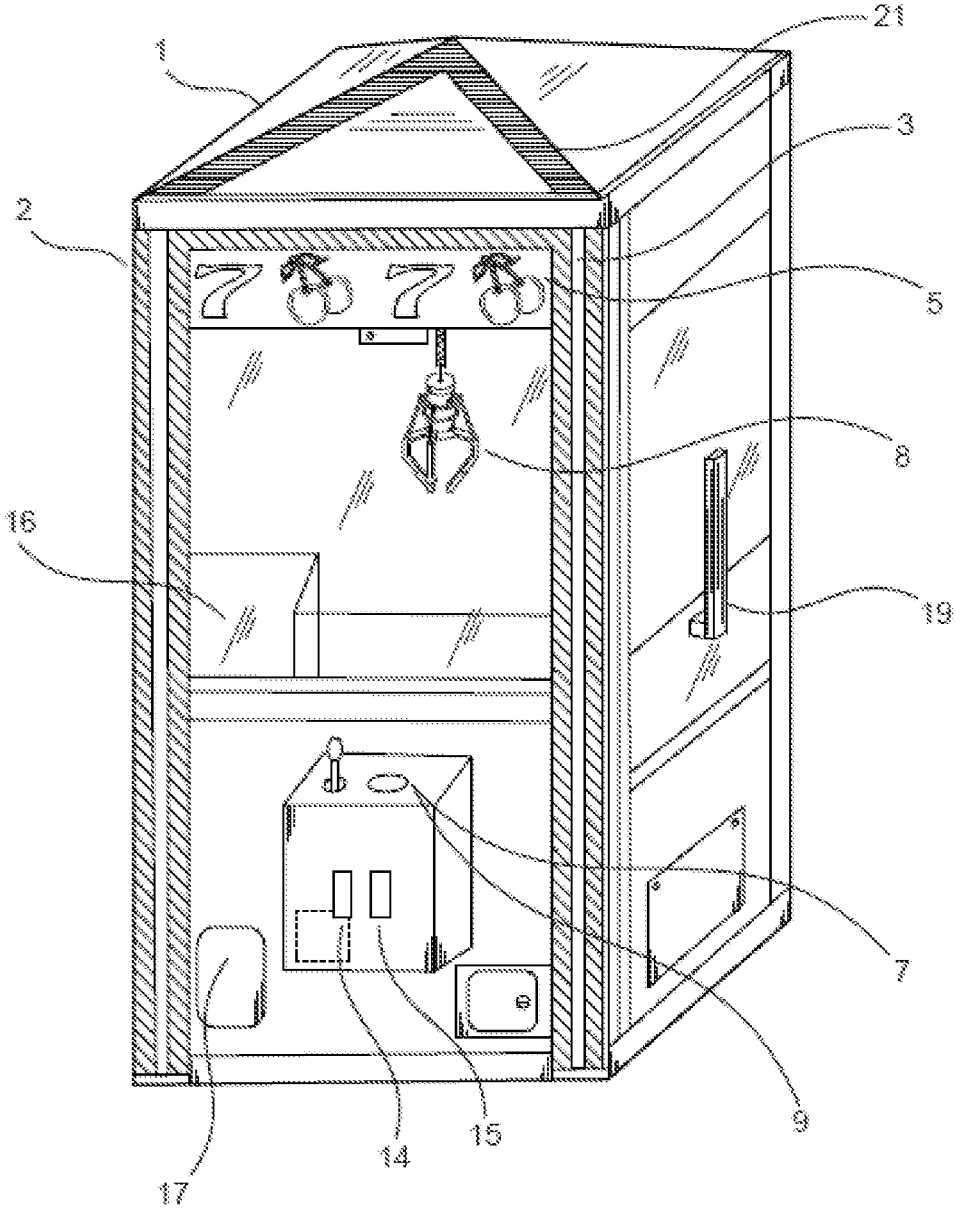
FIG. 5 is a perspective view of the crane apparatus according to an alternative embodiment of the present invention featuring a one arm bandit or slot machine handle.
Figure 6:
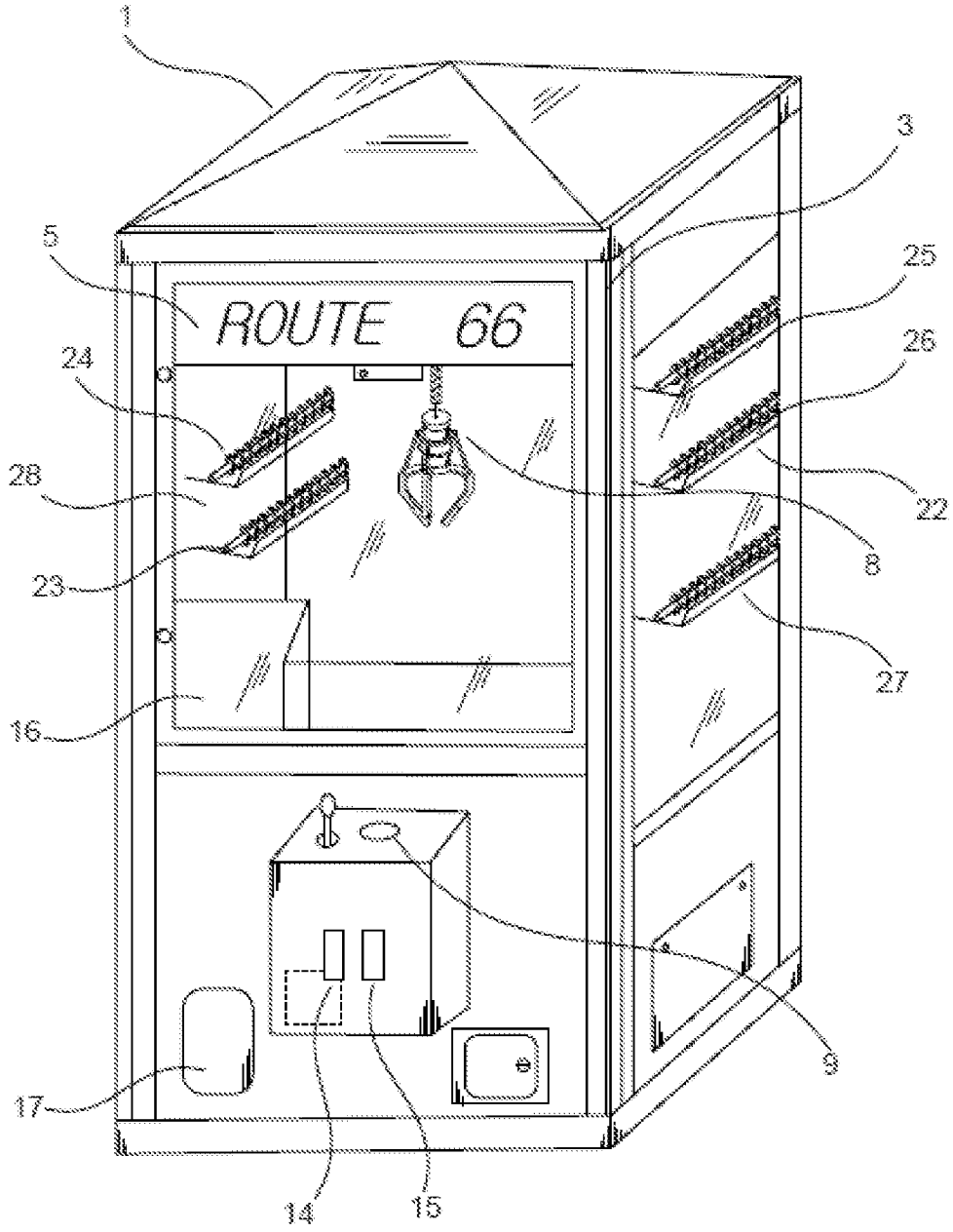
FIG. 6 is a perspective view of the crane apparatus according to an alternative embodiment of the present invention featuring a second change price crane and hanging price win feature.

The basic components of the claw game are a cabinet 1 as shown in FIG. 1, a crane mechanism 31 mounted inside the cabinet 1, and motorized means 32 for maneuvering the crane to pick up prizes as shown in FIGS. 2-3 and discharge them through an outlet or prize door 17, a PCB, power supply accessed through a board access panel 30, currency detector, credit/timer display, joystick 7, wiring harness, bridge assembly, button 9, claw 8, and coin door 29 for retrieving deposited money or coins by the operator. Not all components are shown or illustrated in the drawings as they are well known in the art and not necessary for one of ordinary skill in the art to make or use the present invention. Drawings of these elements are necessary for the understanding of the subject matter to be patented. As shown in FIG. 4, the claw 8 will have two or more prongs or arms 10, 11, 12, although most claws 8 will usually have three prongs or arms 10, 11, 12 as shown in the Figures.

The cabinet 1, as shown in the Figures is usually constructed of medium-density fiberboard (MDF), aluminum alloy, plastic or any other wood, metal or composite material. The window 13 at the front of the machine is made of glass or acrylic. The marquee 5 is a branded graphic created specifically for the crane game, game of chance, and slot machine game and is located behind or on the front panel window 13 of the cabinet 1.

The player places coins into the machine's coin slots 14 and 15, which then allows the player to manipulate a joystick 7 or one or more buttons 9 that controls the claw 8 for a variable time, controlled by the operator. The player is able to move the claw 8 back, forth and sideways. At the end of the play time or earlier if the player presses a trigger button 9, the claw 8 descends or drops down and makes an attempt to grip. After making the gripping attempt, the claw 8 then moves over an opening 16 in the corner of the case and releases its contents as shown in FIGS. 1-4. If the player is successful, then the prize the claw 8 is holding is dropped into the opening 16 and dispensed through a chute into a hatch for collection 17. In a conventional crane machine game, the player will have an allotted period of play time before the crane becomes inoperable. In a win ever time crane game, the player can continue to maneuver the claw 8 until a prize is detected in the dispensing chute opening 16 by detection means.

Upon ending play on the first game, the player starts play on a second game, which is a game of chance. The second game requires a player to press a button 9 to stop moving, flashing lights 18 on an area to win a prize. The second game is located on the corners of the cabinet 2 and 3 and above the marquee 5 on the top of the crane game machine cabinet 4 as shown in FIGS. 1 and 3. In the second game, the player may or may not be guaranteed to win a prize. The player presses a button 9 to stop the moving, flashing lights 18, and, if won, a prize is dispensed based on the location on the corners of the cabinet 2 and 3 above the marquee 5 on the top of the crane game machine cabinet 4 where the moving, flashing lights 18 were stopped when the player pressed the button 9.

The moving, flashing lights 18 on the corners of the cabinet 2 and 3 above the marquee 5 on the top of the crane game machine cabinet 4 may move in a complete circle or may move away in from each other from a shared starting point in two or more lines starting at a shared location in a path of any shape until they meet. At the meeting point the lights 18 will start moving back on the same path traveled to the shared starting point. The player will have a goal of stopping the lights 18 on a given location on the corners of the cabinet 2 and 3 above the marquee 5 on the top of the crane game machine cabinet 4 or area on the marquee 5 as they move. If the player stops the lights 18 in the correct location or area a prize will be awarded. If the player wins the game, the prize may be products or tickets that can be redeemed via an online website/store or even additional crane free plays.

Upon ending play on the second game, the player starts play on a third and final game. In the third game, the player plays a slot machine game or other similar game of chance also located on the marquee 5 of the crane machine as shown in FIGS. 1 and 3. The player presses a button 9, and a slot machine game is started and played. A prize is dispensed based on the results of the slot machine display and the payout system advertised and in place on the machine. If the player wins the slot machine game, the prize may be products or tickets that can be redeemed via an online website/store or even additional crane free plays.

The games may be played in any order, individually, or in any combination or order of game play. The prizes and payout may also be adjusted as desired by the operator. The game play of each game may also be adjusted by the operator to control winning percentages and payouts. Any tickets or coupons dispensed for any gameplay or combination thereof is printed and delivered to the player via the thermal printer and corresponding opening in the cabinet door.

In alternative embodiment, the crane machine may be win every time or traditional crane machines or replaced with any arcade machine or possibly a juke box in any combination with one or more of the games of chance described above.

FIG. 2 is a perspective view of the crane apparatus according to yet another alternative embodiment of the present invention featuring a one arm bandit or slot machine handle 19. In this alternative embodiment, a one arm bandit or slot machine handle 19 is located on one external surface 20 of the cabinet 1 to start a game of chance. In this alternative embodiment, the game of chance is a replicated slot machine. This alternative embodiment combines the traditional crane machine game with a jackpot feature that replicates a slot machine. In this alternative embodiment, a user would first play the traditional crane game, then they would play a win every time game which would consists of a user pressing a button 9 to stop moving, flashing lights 18 located on the corners of the cabinet 2 and 3 and above the marquee 5 on the top 4 of the crane game machine cabinet 1 to win a prize; and finally, a user would have the opportunity to play a third, game of chance which replicates a slot machine and requires the user to pull the one arm bandit handle 19 located on an exterior surface 20 of the crane cabinet 1.

Now referring to FIG. 3, yet another alternative embodiment of the crane machine is shown where the traditional crane machine and cabinet 1 is additionally comprised of running lights 21 and a hanging prize win feature where prizes are hung from one or more hangers 22 in one or more locations 23, 24, 25, 26, and 27 on the inside surface 28 of the crane machine cabinet 1. Stopping the running lights 21 on a win position by pressing a button 9 allows the corresponding hanger location 23, 24, 25, 26, and 27 on the inside surface 28 of the crane machine cabinet 1 to dispense a prize. The prize is dispensed through an outlet or collection hatch 17 to the player. The traditional crane control joystick 7 and button 9 operates the claw 8 just as in other embodiments of the invention.

Figure 7:
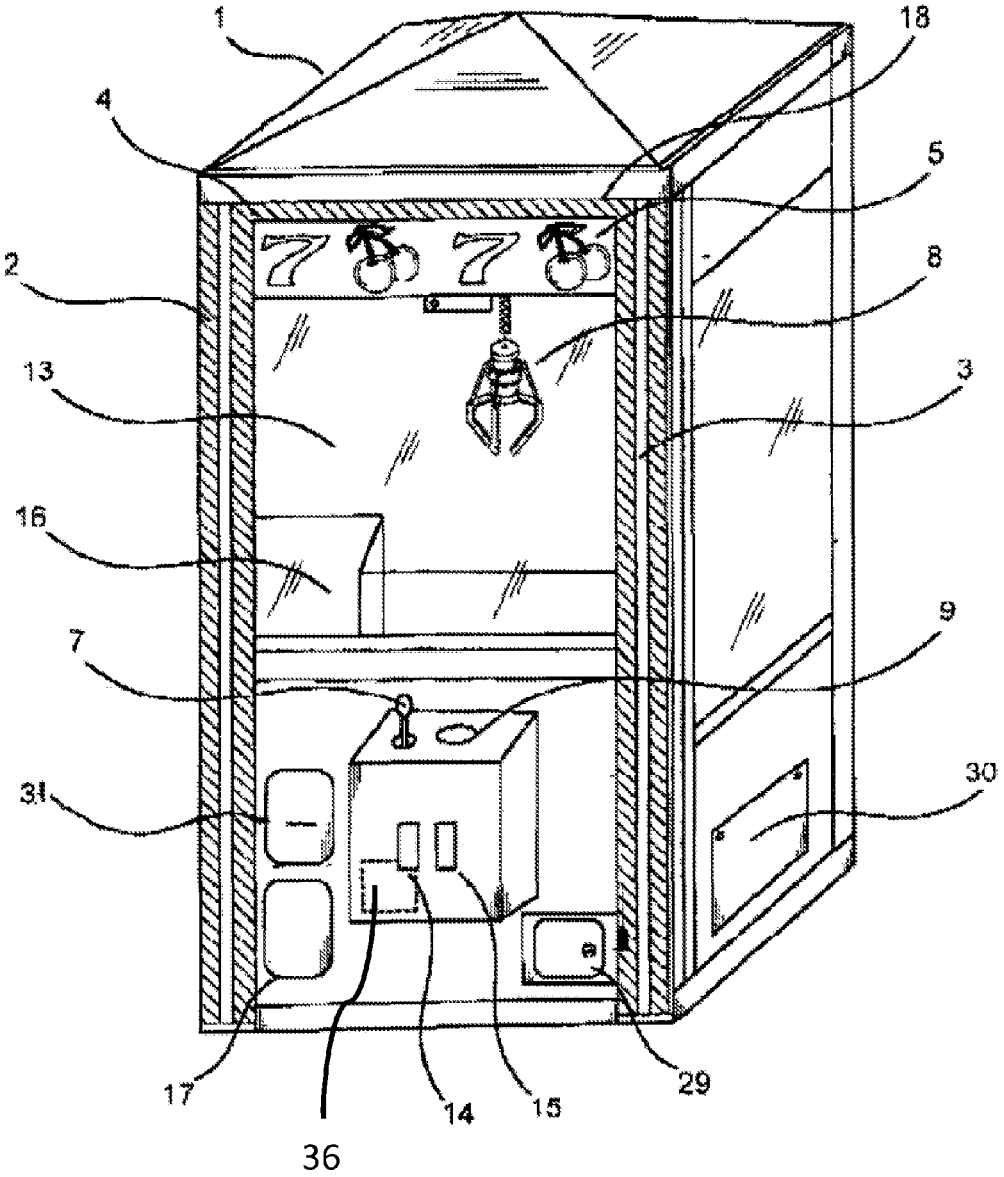
FIG. 7 illustrates the external view of the amusement device of the present invention with a card swipe and thermal printer dispenser.

Now referring to FIG. 7, the present invention is shown with a thermal printer opening 31 in the cabinet door for printing and distributing tickets or coupons. If tickets are printed, they could be redeemable on site or online. If coupons are printed, the printer can be programmed to print selected coupons, which can be direct business that are local to the machine or business within a certain geographical location of the machine. This enables the amusement device to provide rewards that players can redeem locally, and allows the machines to drive users to the host business or other business in the surrounding area. This provides additional revenue to the machine owner by allowing them to sell the coupons as advertising to local businesses creating an additional revenue stream and keeping the playing and use of such devices relevant to the public, in an economic environment that is showing a decrease in the use of such devices by the general public.

Figure 8:
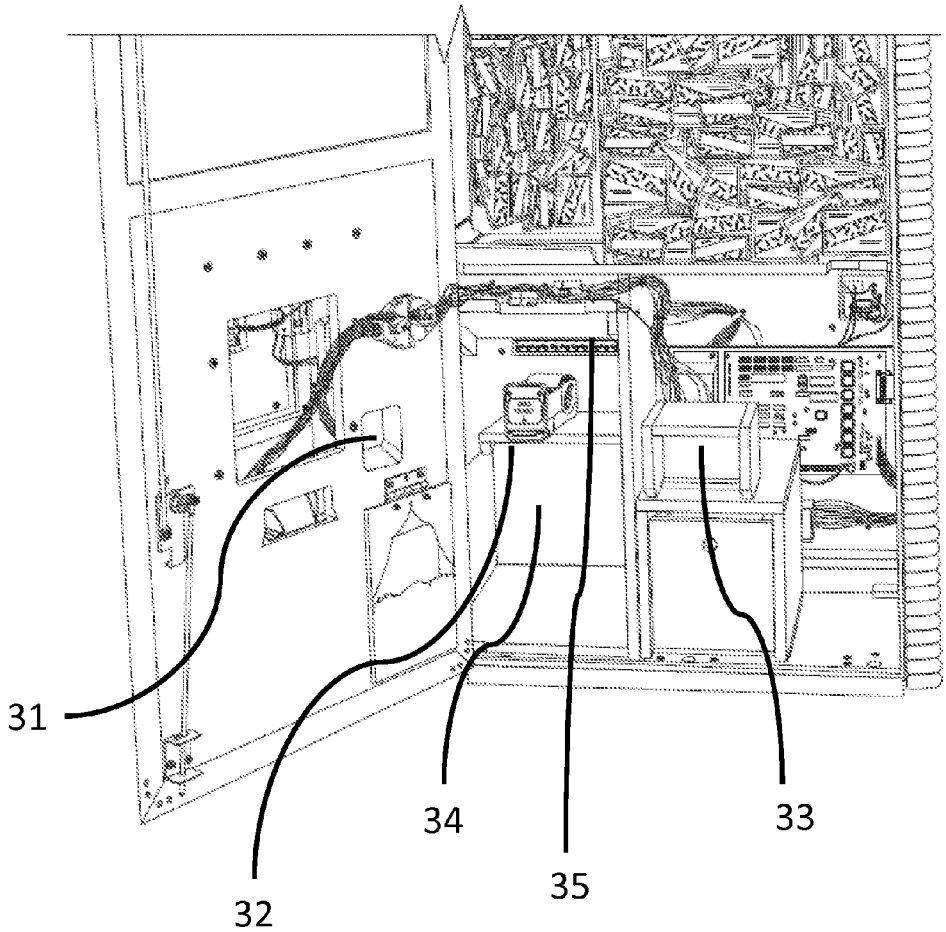
FIG. 8 illustrates the amusement device of the present invention in an open door position showing the bill acceptor mounted to the crane machine cabinet and the thermal printer mounted in the prize cute.
Figure 9:
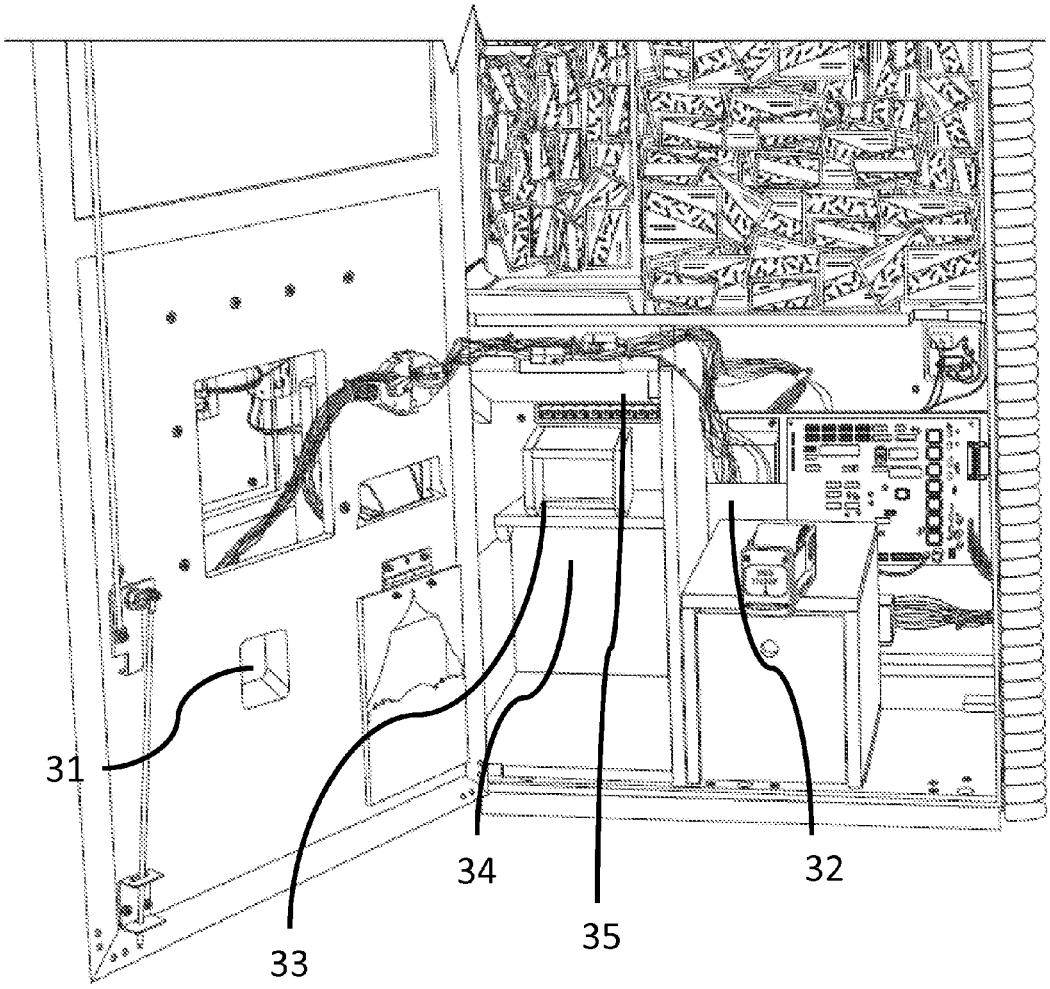
FIG. 9 illustrates the amusement device of the present invention in an open door position showing the thermal printer mounted to the crane machine cabinet and the bill accepter mounted in the prize cute.

FIGS. 8 and 9 illustrate the amusement machine device in combination with a thermal printer 32 and bill acceptor 33. The bill acceptor 33 and thermal printer 32 can be mounted anywhere in or on the machine, although the most common mounting positions are to place the thermal printer 32 in the prize chute 34 with a protective deflector 35 to protect the thermal printer 32 but still allow any prizes collected by the crane arm to fall down the prize shoot 34.

Figure 10:
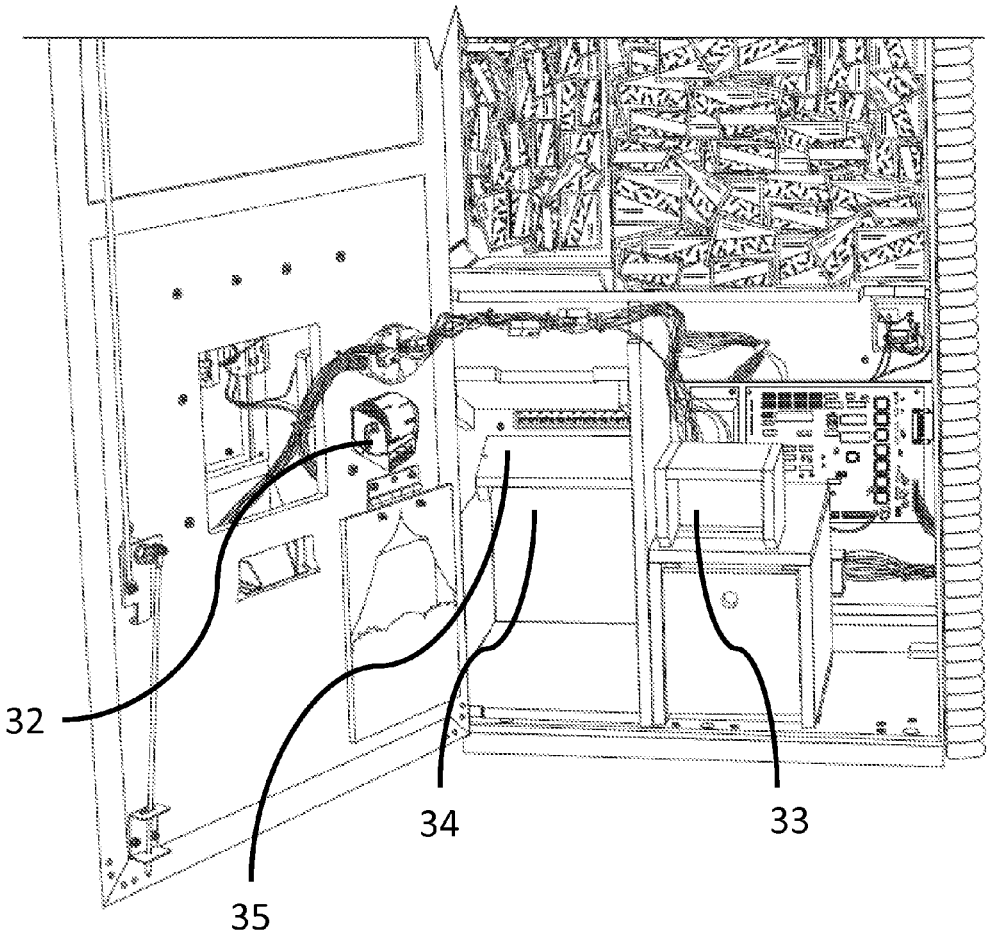
FIG. 10 illustrates the amusement device of the present invention in an open door position showing the bill acceptor mounted to the crane machine cabinet and the thermal printer mounted in the door.
Figure 11:
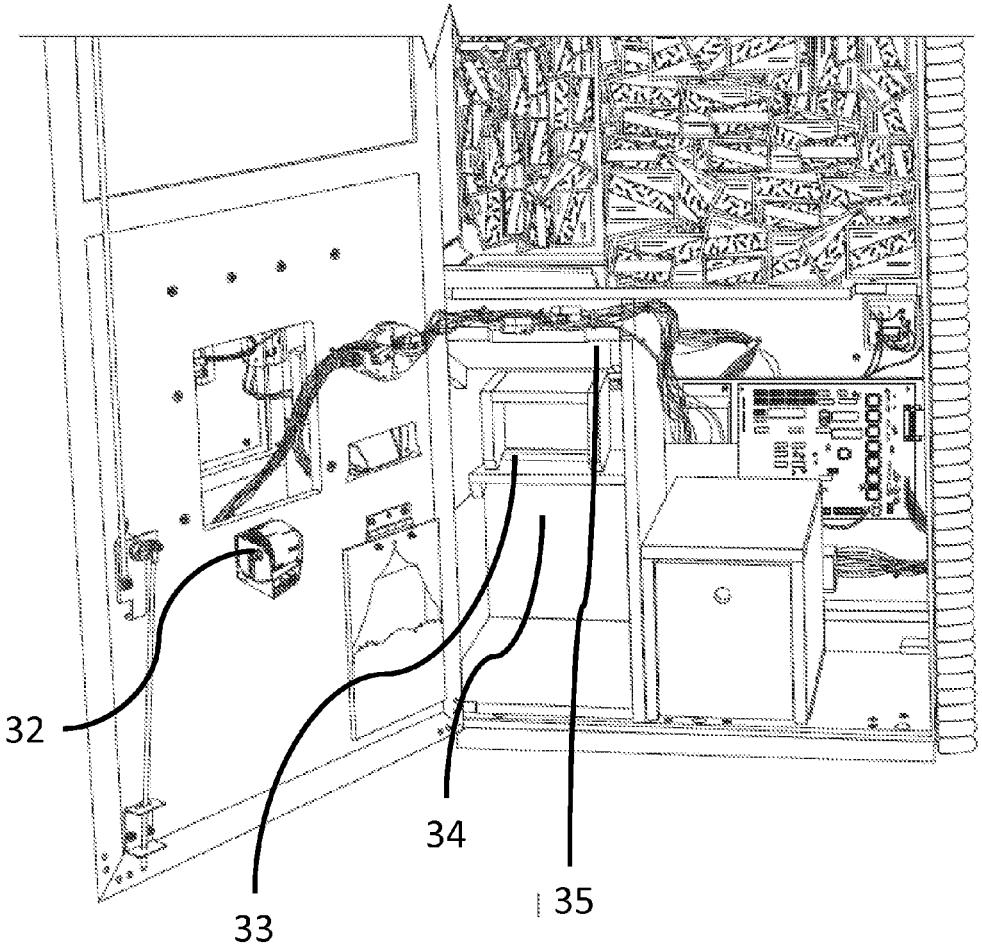
FIG. 11 illustrates the amusement device of the present invention in an open door position showing the thermal printer mounted to the crane machine door and the bill accepter mounted in the prize cute.

As shown in FIGS. 10 and 11, the thermal printer 32 can also be mounted to the door 35 In this embodiment the thermal printer 32 would be mounted to the door 35, not inside the machine. In the prize chute position, there would still be a wooden prize deflector 35 to protect the thermal printer 32 but still allow the prize to fall down the chute.

A credit card swipe 36 can be used for standard Visa or MC or for specific player's cards at casinos or other gaming establishments or arcades where the establishments add credits to a player's card that the players can use on any machine instead of cash. This credit card swipe 36 is typically located alongside the coin slots 14 and 15, but could be located on any part of the machine accessible to a player.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The invention claimed is:

1. An amusement machine comprising
a cabinet containing:
an apparatus for playing a crane game;
the apparatus comprising a cabinet that has corners, a crane mechanism mounted inside the cabinet, and motorized means for maneuvering the crane to pick up prizes and discharge them through an outlet via prize chute;
a printer for printing and dispensing coupons targeted to one or more businesses in the local geographical area of the machine, as additional or consolation prizes for playing the game when no prize is won; an apparatus for playing a win every time game; the apparatus comprising a button to stop moving, flashing lights located on the corners of the cabinet and above a marquee on a top of the crane game machine cabinet to win a prize in a win every time game; and the printer dispenses a specific prize coupon depending on the location of the flashing lights when the button is pressed to stop the moving, flashing lights.

2. The machine of claim 1, wherein the printer is mounted to the inside surface of the door.

3. The machine of claim 1, wherein the printer is mounted an internal mounting point inside the cabinet and engages a door opening when the door is in a closed position.

4. The machine of claim 1, wherein the printer is mounted in the chute position and further comprising a prize deflector to protect the printer but allow prizes to fall down the prize chute.

5. The machine of claim 1, further comprising a credit card swipe for use with standard credit cards for payment.

6. The machine of claim 5, wherein the credit card swipe accepts player's cards for storing and spending credits on any machine instead of cash in a given location.

7. The machine of claim 1 further comprising
an apparatus for playing a game of chance; and
the apparatus comprising a button to start a game of chance located on a marquee of the cabinet to win a prize.

8. The machine of claim 7 wherein, the game of chance is a simulated slot machine.

9. The machine of claim 8, further comprising a slot machine handle on one external surface to start a game of chance, which is a simulated slot machine.

10. The machine of claim 7 wherein, the prizes for playing the game of chance may be products, coupons, or tickets that can be redeemed via an online website/store or additional crane game free plays.

11. The machine of claim 7 wherein,
the crane machine cabinet is additionally comprised of running lights and a hanging prize win feature where prizes are hung from one or more hangers in one or more locations on the inside surface of the crane machine cabinet;
the running lights are stopped on a win position by pressing a button allows the corresponding hanger location on the inside surface of the crane machine cabinet to dispense a prize;
the prize is dispensed through an outlet or collection hatch; and
a crane control joystick and button operate the claw.

12. The machine of claim 1, further comprising
an apparatus for playing a game of chance;
the apparatus comprising a button to start a game of chance located on the marquee of the cabinet to win a prize; and
awarding a variety of prizes that are fulfilled by a printed coupon dispensed by the printer.

13. The machine of claim 1, wherein,
the printer dispenses general printed coupons as one of the prizes for playing; and
the printer is programmed to print the general coupons.

14. The machine of claim 1 wherein,
in the win every time game, the player is guaranteed to win a prize; and
a variety of prizes that are fulfilled by a printed coupon are dispensed by the printer.

15. The machine of claim 14 wherein, the prizes may be products, tickets, coupons, award a prize, additional crane free plays, or moving on to or access a third game for playing.

16. The machine of claim 1 wherein, in the win every time game, the player can continue to maneuver the claw until a prize is detected in the dispensing chute opening by detection means.

17. A method for providing an amusement machine including a crane game in combination with a win every time game and a game of chance, comprising the steps of:
providing a crane machine cabinet with an apparatus for playing a crane game, and an apparatus for playing a win every time game;
playing a first game, which is a crane game;

locating a second game on the corners of the cabinet and above a marquee on a top of the crane game machine cabinet;

playing a second game, which is a game of chance;

requiring the pressing of a button to stop moving, flashing lights on a designated area along the marquee and corners of the cabinet to win a prize;

if the second game is won, dispensing a prize based on the location on the corners of the cabinet and above the marquee on the top of the crane game machine cabinet where the moving, flashing lights were stopped when the button was pressed;

awarding a variety of prizes that are fulfilled by a printed coupon dispensed by a printer; and wherein the prize is products or tickets that can be redeemed via an online website/store or even additional crane free plays printed on a printer and dispensed to the winner.

18. The method of claim 17, further comprising the steps of starting play on a third and final game upon ending play on the second game;

playing a slot machine game or other similar game of chance, in a third game, also located on the marquee of the crane machine;

pressing a button and a slot machine game is started and played; and dispensing a prize based on the results of the slot machine display and the payout system advertised and in place on the machine;

awarding a variety of prizes that are fulfilled by a printed coupon dispensed by the printer; and the prized dispensed is printed on a thermal printer.

19. The method of claim 17, further comprising the steps of programming the printer with predetermined coupons; and programming the printer with predetermined tickets.

* * * * *